US005544560A

United States Patent [19]

Biasini

[11] Patent Number: 5,544,560

[45] Date of Patent: Aug. 13, 1996

[54] WIND INSTRUMENT STAND

[76] Inventor: Americole R. Biasini, 2101 Ontario St., Bellingham, Wash. 98226

[21] Appl. No.: 202,434

[22] Filed: Feb. 28, 1994

[51] Int. Cl.[6] ..... G10D 7/10

[52] U.S. Cl. ..... 84/387 A; 84/385 A

[58] Field of Search ..... 84/385 A, 387 A, 84/453

[56] References Cited

U.S. PATENT DOCUMENTS

| | | | |
|---|---|---|---|
| 1,900,718 | 3/1933 | Lang | 84/385 A |
| 4,145,950 | 3/1979 | Glantz | 84/385 R |
| 4,304,166 | 12/1981 | Stefano et al. | 84/385 A |
| 4,986,158 | 1/1991 | Johnson | 84/385 A |

OTHER PUBLICATIONS

Musicorp, 1994 catalog, "Holiday Sale" pp. 211–213.

Kaman Music Products, Fall 1992 "Reference Manual and Catalog," pp. 244–245.

Konig and Meyer, 1993 "Product Range" catalog, pp. 18–31.

Davitt and Hanser, 1994–1995 "National Music Network-"catalog.

Harris–Teller, 1993–1994 "Catalog of Musical Merchandise.".

*Primary Examiner*—Patrick J. Stanzione

[57] ABSTRACT

A wind instrument stand which can be assembled and dissasembled, including a peg stand base, a hinged back plate, and a music stand attachment device. The hinged back plate and attachment device permit adjustable attachment of the instrument stand to the upright support of a music stand. A removable bi-peg adapter adapts the peg stand base for use with two additional instruments. Peg adapters fit on the base and the bi-peg adapter, allowing use of the wind instrument stand with one or more wind instruments.

19 Claims, 11 Drawing Sheets

WIND INSTRUMENT STAND

TECHNICAL FIELD

This invention relates to an apparatus for the safe temporary storage of a variety of wind instruments. More particularly, this invention relates to an apparatus for safely temporarily holding a piccolo, flute, recorder, oboe, clarinet, or trumpet, or a combination of any three, while at the same time making each instrument easily accessible to the musician.

BACKGROUND OF THE INVENTION

The adaptable instrument stand of the present invention offers solutions to several problems unique to wind instrument musicians. While some musicians play only one type of instrument, many play more than one, often alternating between instruments during the performance of a single musical number or a series of numbers. It is important that the musician have quick and easy access to the one or more instruments being played, while at the same time, have the ability to quickly and safely store the instruments not being used, if multiple instruments are being used.

The invention of this application addresses the above needs in several ways. This instrument stand, when attached to the upright support member of a music stand, provides safe and stable temporary instrument storage. The low center of gravity afforded by the attachment means makes it very unlikely that the instruments will be tipped over, even if the music stand to which it is attached is tipped to an extreme angle. Additionally, the instrument stand is attached in the protected area at the base of a music stand, an area not likely to be intruded upon.

This instrument stand is compact and can be easily disassembled into components of a size small enough to fit in many instrument cases. In addition, it is easily adaptable to fit a variety of instruments, and may be quickly modified should the need arise. With the use of an adapter, the instrument stand may be adapted from single instrument use to multiple instrument use.

DETAILED DESCRIPTION OF THE INVENTION

Figure 1:
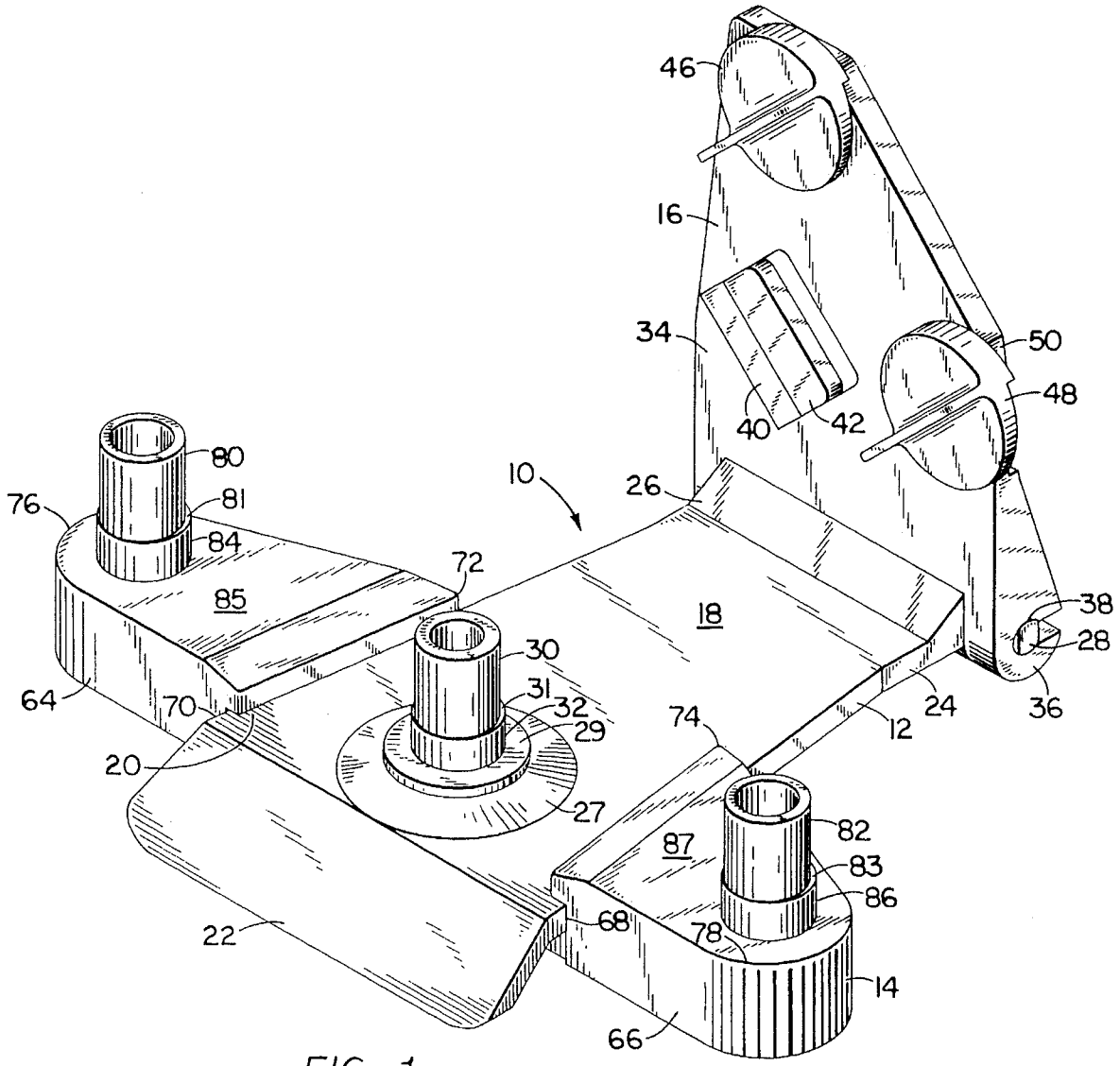
FIG. 1 is a isometric view of the assembled peg stand base, comprised of the peg stand base, the removable bi-peg adapter, and a hinged portion.

The assembled peg stand base, shown generally as 10 is illustrated in FIG. 1. The peg stand is comprised of three parts: the peg stand base 12, the removable bi-peg adapter 14 and a hinged portion 16 which supports an attachment to a music stand vertical post.

Figure 2A:
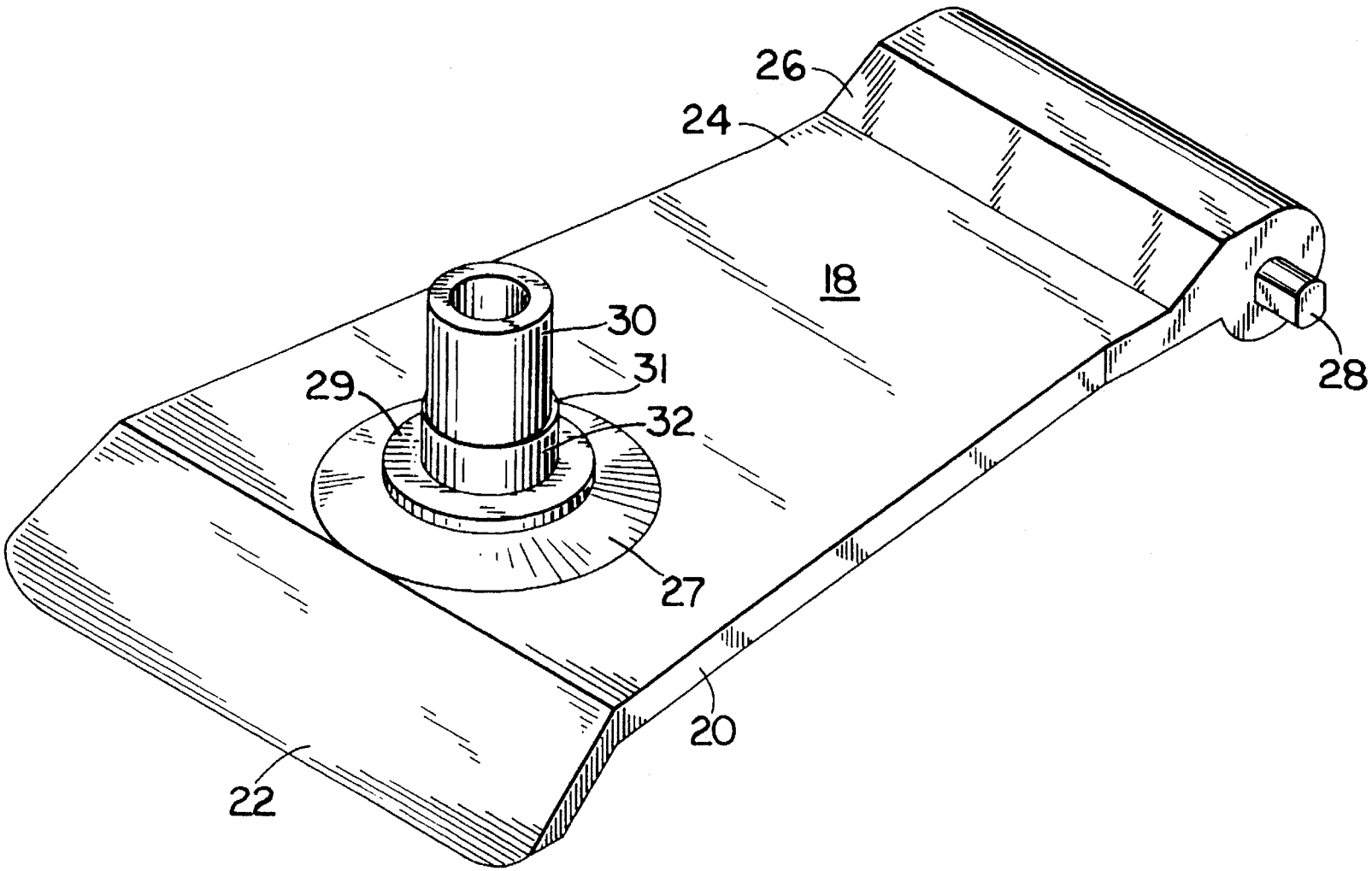
FIG. 2A is an overhead isometric view of the peg stand base.
Figure 2B:
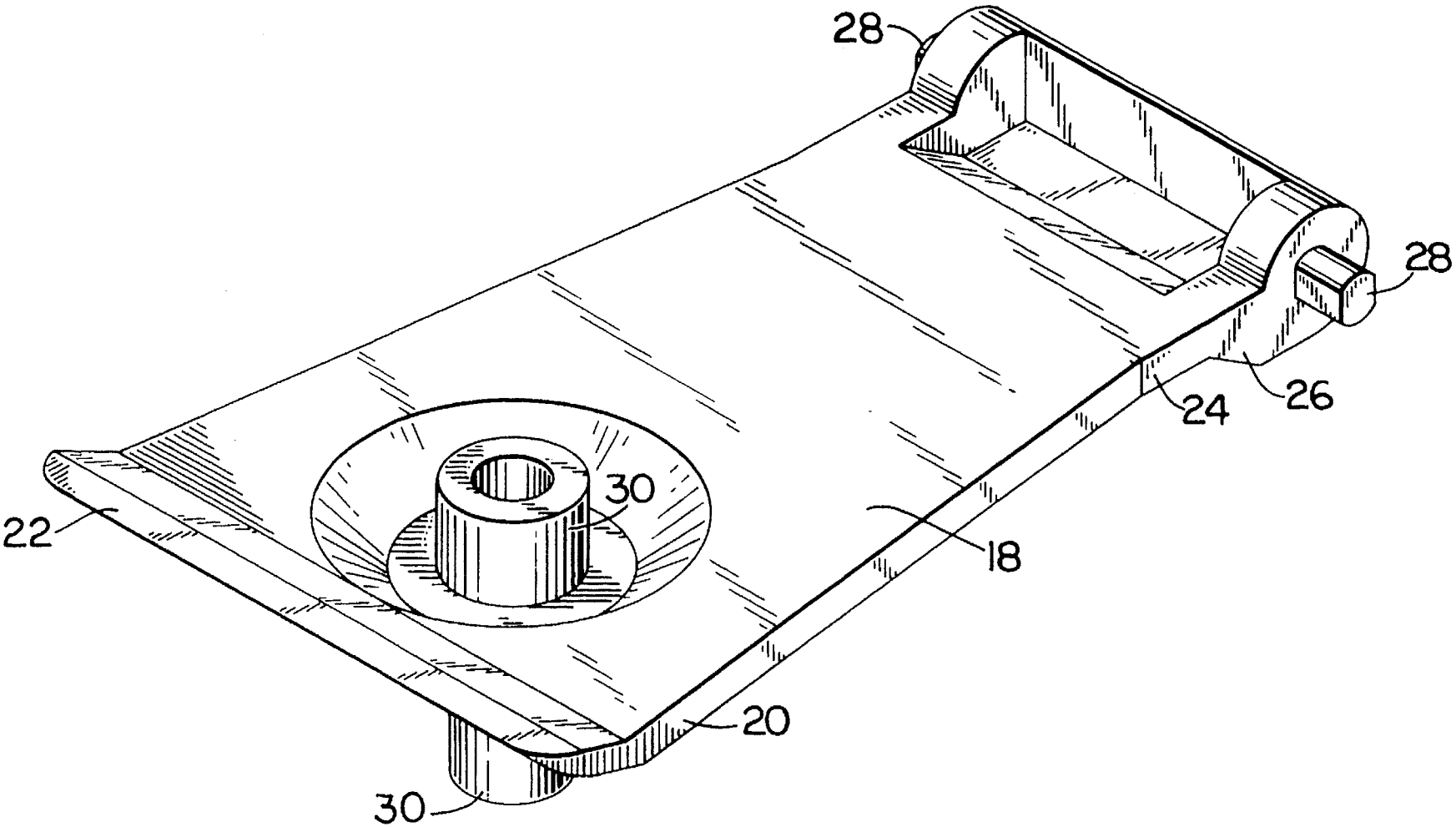
FIG. 2B is a isometric view of the underside of the peg stand base.

Peg stand base 12 as shown in FIGS. 2A and 2B comprises a trapezoidal shaped deck plate 18. At one end 20 of deck plate 18 is a downward angled tongue 22 which supports deck plate 18 above the floor. At end 24 of deck plate 18 is a thickened portion 26 from which a hinge peg 28 extends perpendicularly from each end. A frustum-shaped element 27 extends upward from deck plate 18 adjacent tongue 22. Atop element 27 is a thin toroidal element 29. Peg 30 extends through elements 27 and 29 and projects from the bottom of deck plate 18. A collar 32 which is slightly off center surrounds peg 30 for about one-third of its height above element 29. The diameter of collar 32 is greater than that of peg 30, resulting in edge 31.

Figure 3C:
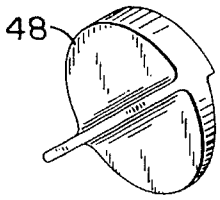
FIG. 3C is a isometric view of the front of the locking cam.
Figure 3A:
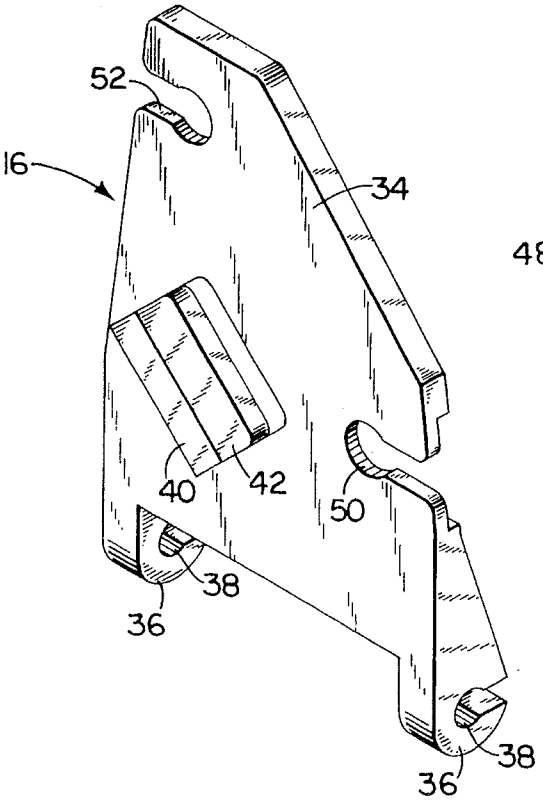
FIG. 3A is a isometric view of the front of the hinged portion.
Figure 3B:
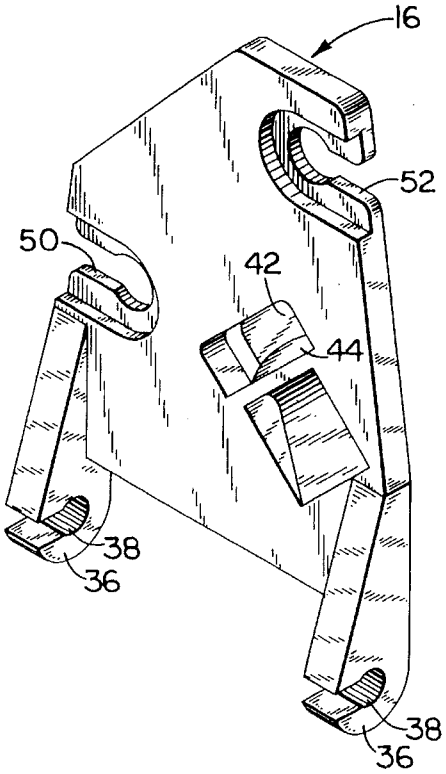
FIG. 3B is a isometric view of the back of the hinged portion.
Figure 3D:
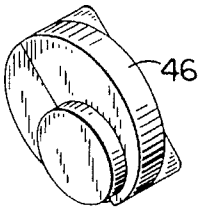
FIG. 3D is a isometric view of the back of the locking cam.

In FIGS. 3A and 3B, hinged portion 16 comprises a flat plate 34 having hinge brackets 36 extending perpendicularly from one end. Each hinge bracket 36 has a centrally located hole 38 for the hinge pegs 28. Each hole 38 has a slotted opening for insertion of hinge pegs 28. Attachment retainer 40 extends angularly upward from plate 34 at one side thereof. Retainer 40 has an extension 42. At a level above the plate 34 and under extension 42 is a curved element 44, shown in FIG. 3B. Above attachment retainer 40 are two pivoted locking cams 46 and 48 shown in FIGS. 3C and 3D. Locking cams 46 and 48 are inserted into snap slots 50 and 52. Locking cams 46 and 48 are each pivoted off center so that they may be rotated downward to hold the music desk attachment 88 (as shown in FIG. 5) in the slot formed under attachment retainer 40.

Figure 4:
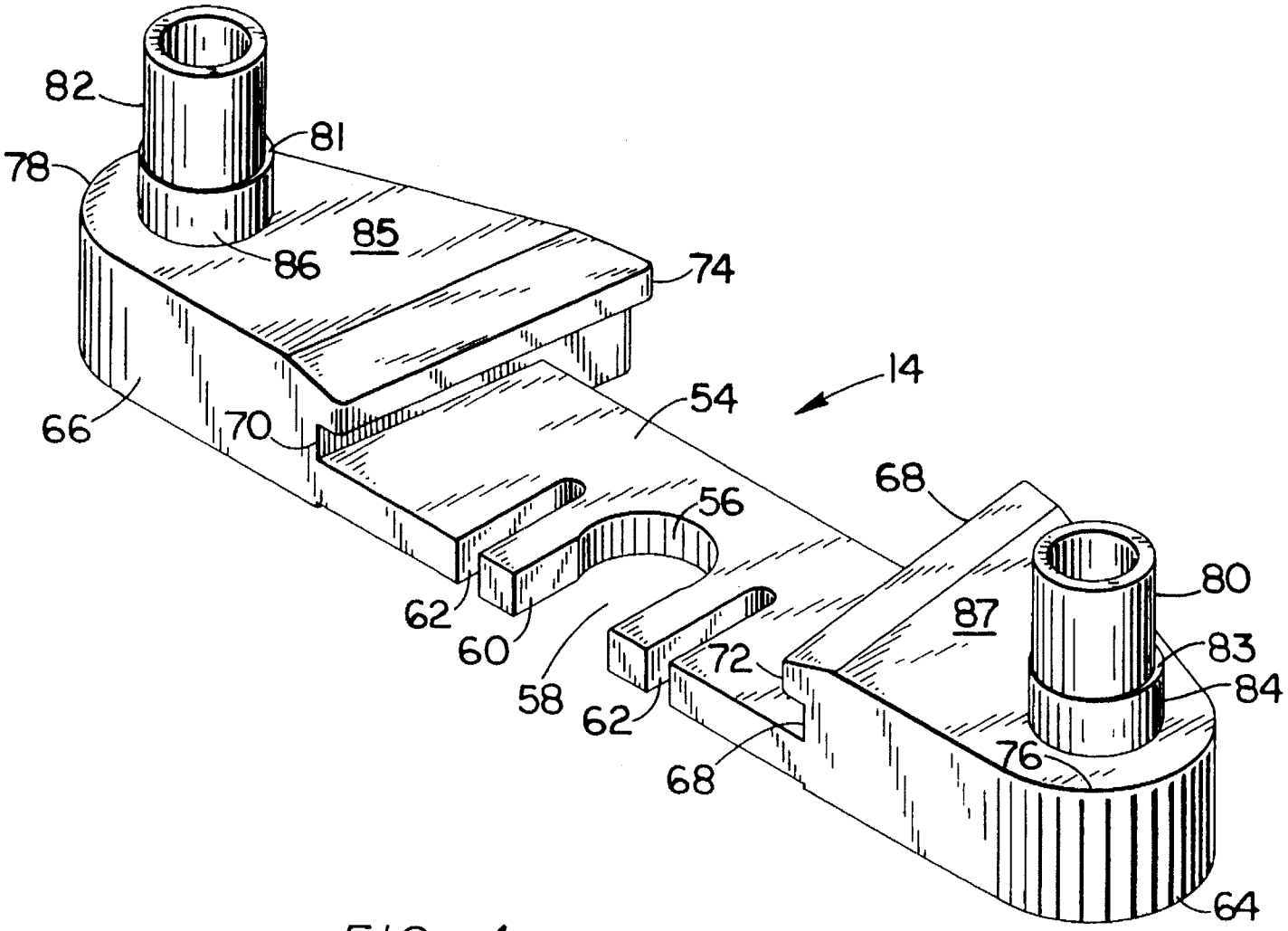
FIG. 4 is a isometric view of the removable bi-peg adapter.

Removable bi-peg adapter 14 shown in FIG. 4 comprises a flat plate 54 having at its center a snap lock 56 for the portion of peg 30 which extends below deck plate 18 (see FIG. 2B). Snap lock 56 comprises a rounded opening 58 which is slightly larger than a semi-circle. A slot 60 which is slightly smaller in diameter than peg 30 extends from opening 58 to the edge of plate 54. On either side of the extensions formed by the snap lock 56 are slots 62 which allow the material to spread while the bi-peg adapter 14 is being attached to or removed from peg 30 (see FIG. 2B). At either end of plate 54 hollow structures 64 and 66 are attached, having flat upper surfaces 87 and 85 respectively. Facing sides 68 and 70 of structures 64 and 66 are angled to the width of deckplate 18 on either side of peg 30. Extensions 72 and 74 extend from the upper edges of structures 64 and 66, the height of the extensions above plate 54 being approximately the thickness of deck plate 18. Near the curved ends 76 and 78 of structures 64 and 66 pegs 80 and 82 extend upward. For about one-third of the length of the pegs 80 and 82, from their bases, collars 84 and 86 are formed, slightly off center so as to form cams for attachment of instrument peg adapter. When bi-peg adapter 14 is snapped into place, pegs 80, 82 and 30 are in a straight line as shown in FIG. 1.

Figure 5B:
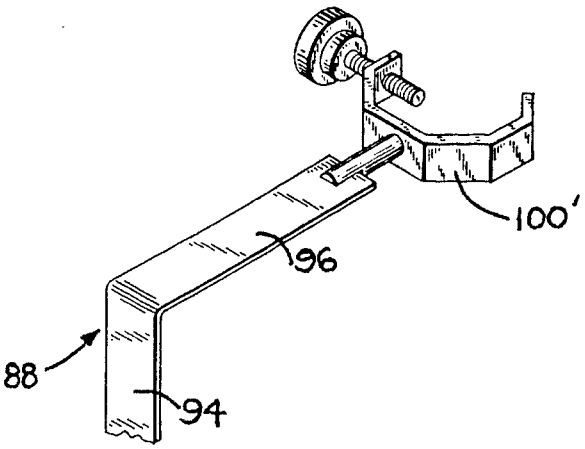
FIG. 5 is a isometric view of the attachment device.
Figure 5A:
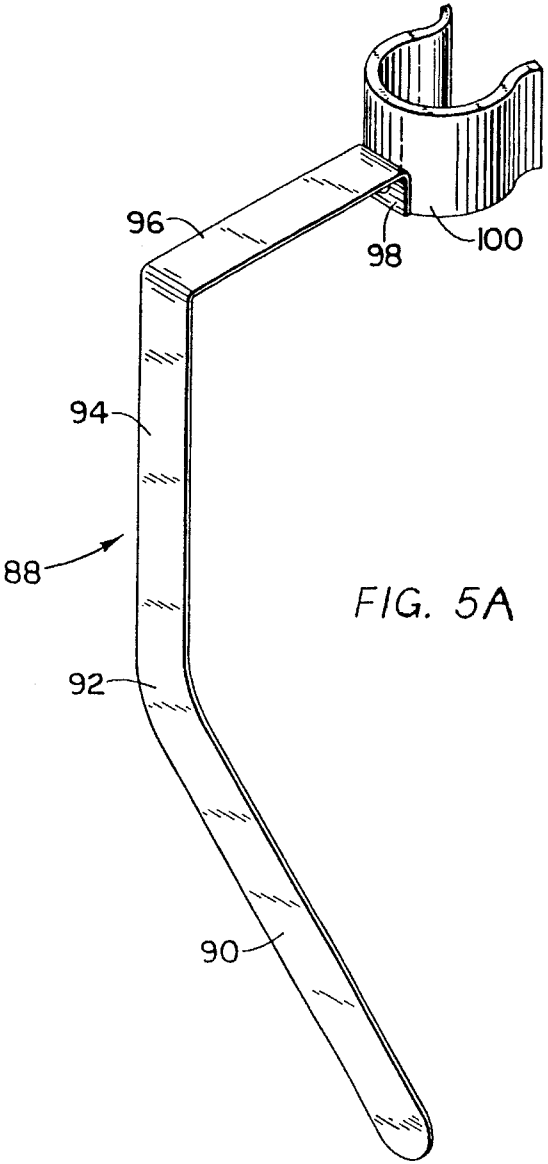

In FIG. 5, the attachment 88 to the music stand comprises a flat strip having a straight portion 90, a curved portion 92, a straight portion 94, a portion 96 bent at a right angle to portion 94, and a straight portion 98 bent at a right angle to portion 96. A clip 100, suitable for pressing to the vertical post of a music stand (see FIG. 13) is attached to portion 98. An alternate mounting clamp 100' for connecting the attachment 88 to the music stand post is illustrated in FIG. 5B. The curve 92 is such that when portion 90 is inserted under projection 42 (see FIGS. 3A and 3B) and clamped therein, portion 94 is vertical, and clip 100 is therefore vertical.

Figure 13:
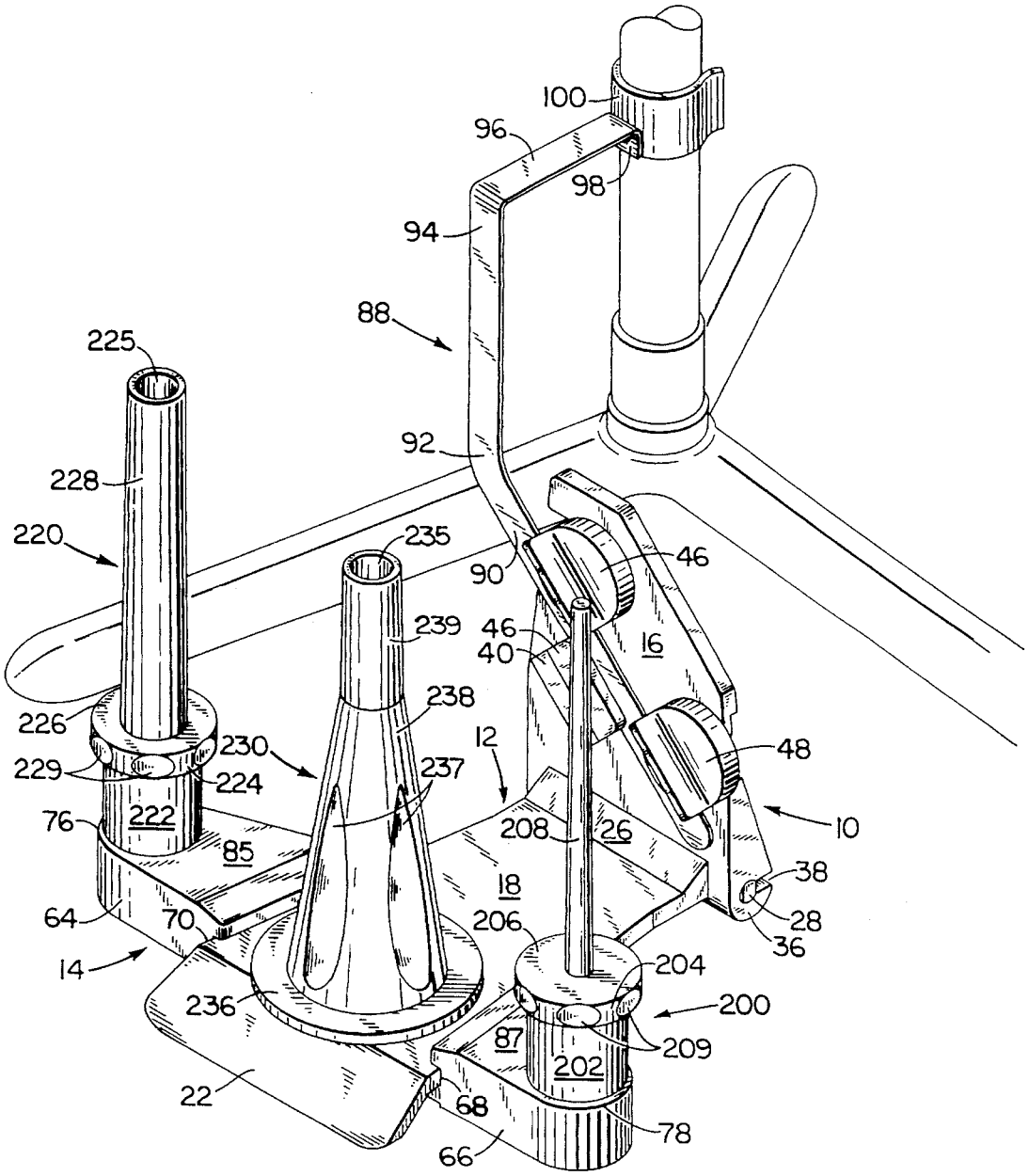
FIG. 13 is a isometric view of the peg stand base attached to the base of the music stand, with the flute and alto recorder peg adapter, the oboe peg adapter, and the piccolo peg adapter mounted on the pegs.

The peg stand base 12 (see FIG. 2A) and removable bi-peg adapter 14 (see FIG. 4) are designed to receive peg adapters for various musical instruments, as illustrated in FIG. 13.

Figure 6B:
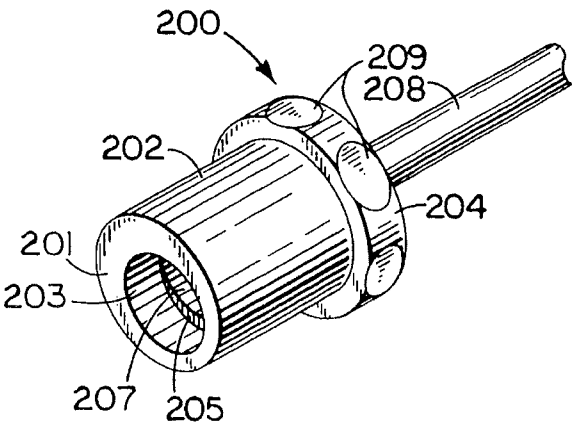
FIG. 6B is a isometric view of the internal detail of the piccolo peg adapter.
Figure 6A:
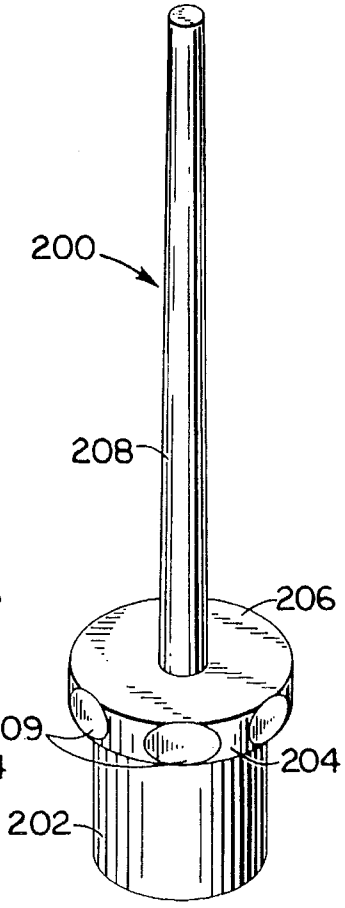
FIG. 6A is a isometric view of a piccolo peg adapter.

The piccolo peg adapter 200 of FIG. 6A and 6B is comprised of a base 202, an instrument supporting surface 206 and a tapered spindle 208. FIG. 6B illustrates base 202 which is an attachment means comprised of lower surface 201, sleeve 203, and internal eccentric collar 207 having a smaller diameter than sleeve 203, and being offset therefrom, thus forming edge 205. The base 202 is topped with disc 204 having an instrument supporting surface 206. Disc 204 is slightly larger in diameter than base 202. Indentations 209 on disc 204 provide a gripping surface for attachment and removal of the piccolo peg adapter 200 to and from peg 30, 80 or 82. A tapered spindle 208 extends in a substantially perpendicular orientation from the instrument supporting surface 206, and is shaped to fit the internal configuration of a piccolo (not shown). The piccolo peg adapter 200 is removably attachable to peg 30 of the peg stand base 12, shown in FIG. 1. The internal diameter of sleeve 203 is substantially equal to the external diameter of collar 32. The internal diameter of eccentric collar 207 is substantially equal to the external diameter of collar 30. Because eccentric collar 207 is offset from sleeve 203 in the same manner in which collar 32 is offset from peg 30, the configuration of edges 31 are substantially identical to the configuration of edge 205. Therefore, edge 205 must be oriented substantially identically to edge 31 in order to slidably attach sleeve 203 and eccentric collar 207 over peg 30 and collar 32. When proper alignment is acheived, the lower surface 201 of peg adapter 200 will rest on surface 29 of peg stand base 12. To secure the piccolo peg adapter 200 to base 12, adapter 200 is rotated on peg 30. This action has the effect of offsetting edges 31 and 205 thereby tightening eccentric collar 207 against peg 30, and sleeve 203 against collar 32, creating a friction lock. When the piccolo peg adapter 200 has been mounted on the peg stand base 12, the tapered spindle 208 is substantially vertically oriented (see FIG. 13). The piccolo (not shown) is then placed onto tapered spindle 208 via the open end of the piccolo, said open end coming to rest on instrument supporting surface 206 of piccolo peg adapter 200.

Figure 7:
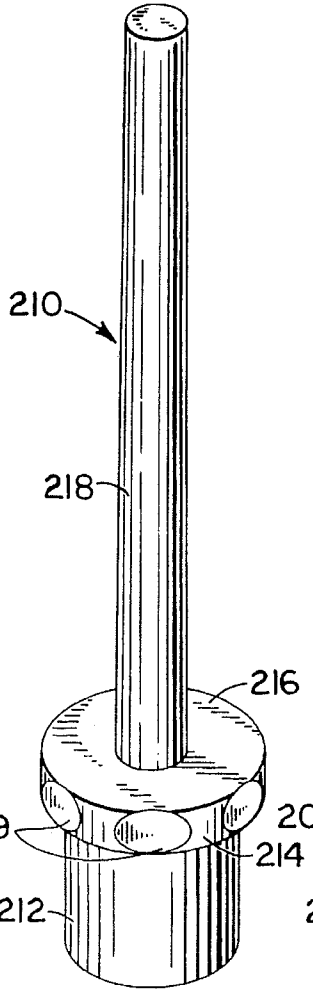
FIG. 7 is a perspective view of an alto recorder peg adapter.

The alto recorder peg adapter 210 of FIG. 7 is comprised of a base 212, a disc 214 having an instrument supporting surface 216 and indentations 219, and a tapered spindle 218. The alto recorder peg adapter 210 is substantially identical to the piccolo peg adapter 200 shown in FIG. 6A and 6B and described above, with the exception of tapered spindle 218. Tapered spindle 218 is of a shape and size which fits the internal configuration of an alto recorder (not shown). The internal base configuration and attachment means of the alto recorder peg adpater 210 are identical in form and function to the internal detail of the piccolo peg adpater 200 shown in FIG. 6B and described herein.

Figure 8:
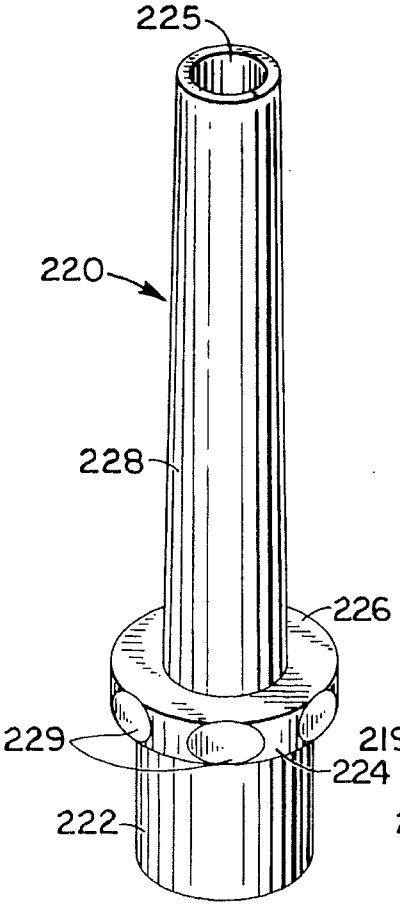
FIG. 8 is a isometric view of a flute and alto recorder peg adapter.

The flute and alto recorder peg adapter 220 of FIG. 8 is comprised of a base 222, a disc 224 having an instrument supporting surface 226 and indentations 229, and a tapered tube 228 having a top opening 225. The flute and alto recorder peg adapter 220 is substantially identical to the piccolo peg adapter 200 shown in FIG. 6A and 6B and described herein, with the exception of the tapered tube 228. Tapered tube 228 is of a shape and size which fits the internal configuration of a flute or an alto recorder (not shown). The internal base congifuration and attachment means of the flute and alto recorder peg adpater 220 are identical in form and function to the internal detail of the piccolo peg adpater shown in FIG. 6B and described herein.

Figure 9A:
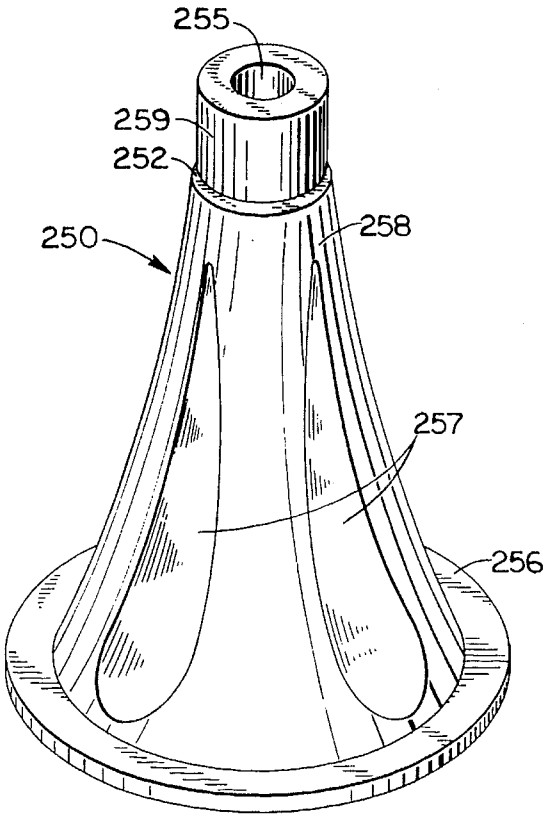
FIG. 9A is a isometric view of a clarinet peg adapter.
Figures 9B, 12A:
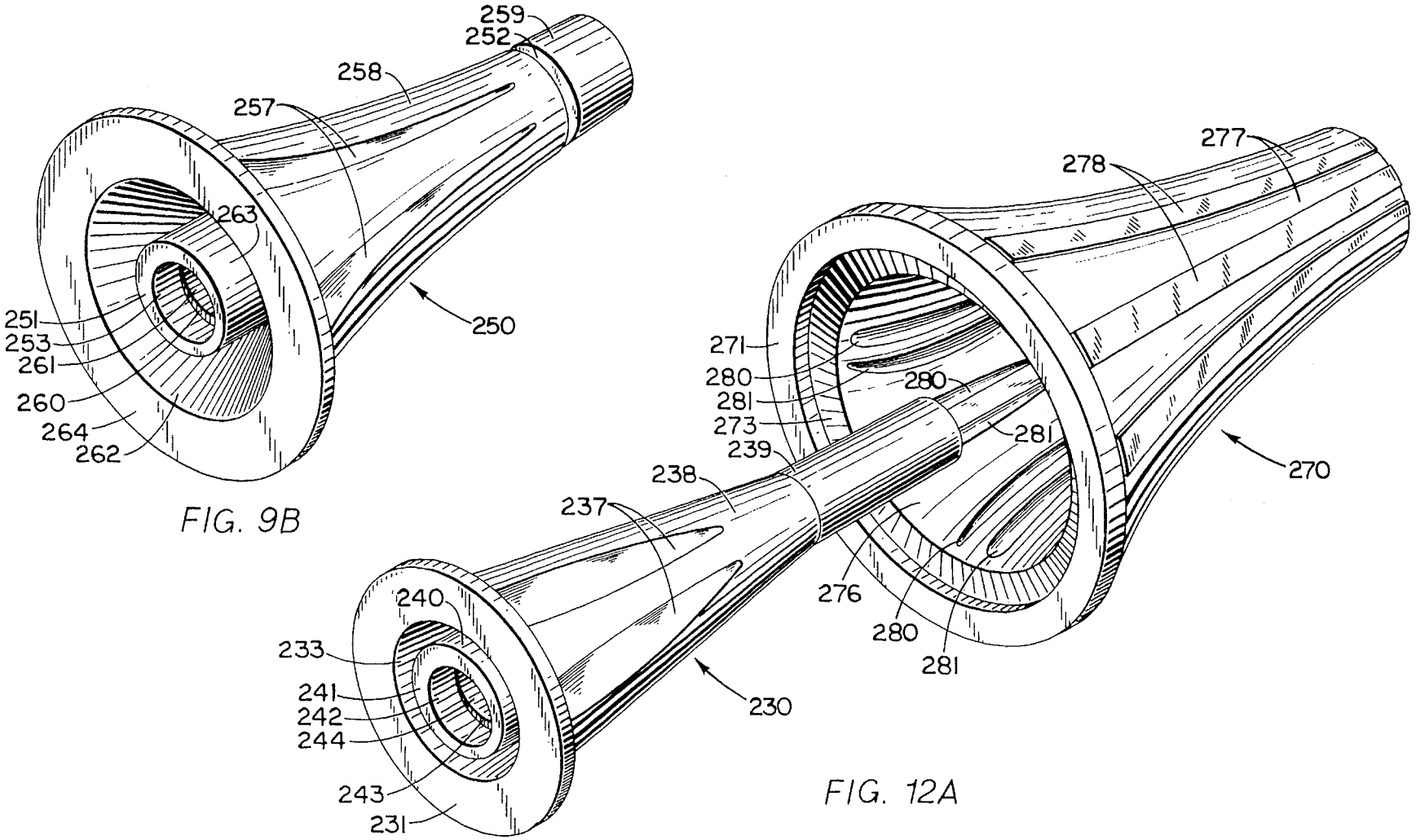
FIG. 9B is a isometric view of the internal detail of the clarinet peg adapter.
FIG. 12A is a isometric view of the internal detail of the oboe peg adapter, also showing its function as the attachment means for the trumpet peg adapter.

FIG. 9A depicts a clarinet peg adapter 250, having a smooth outer surface 258, a plurality of recessed outer surfaces 257, and instrument support surface 256. A groove 252 separates smooth outer surface 258 from tubular extension 259 having opening 255. FIG. 9B is a drawing of the underside of clarinet peg adapter 250, showing flat underside 264, an attachment means 263, and cavity 262 between flat underside 264 and attachment means 263. The attachment means 263 is comprised of lower surface 251, sleeve 253, and internal eccentric collar 261 having a smaller diameter than sleeve 253, and being offset therefrom, thus forming edge 260. The attachment means 263 of clarinet peg adapter 250 attaches to peg stand base 12 in a manner identical to that described above for the piccolo peg adapter 200. The smooth outer surface 258 of clarinet peg adapter 250 is of a size and shape which will accomodate the flare end of a clarinet (not shown) by lowering the flare end over the clarinet peg adapter 250 until the instrument is securely seated on the instrument support surface 256.

Figure 10:
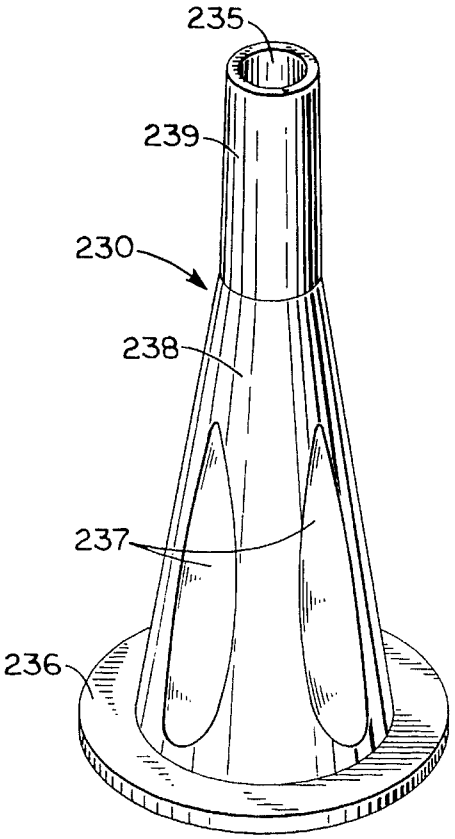
FIG. 10 is a isometric view of an oboe peg adapter.

FIG. 10 depicts an oboe peg adapter 230, having a smooth outer surface 238, a plurality of recessed outer surfaces 237, tubular extension 239, upper opening 235, and instrument support surface 236. FIG. 12A illustrates flat underside 231, attachment means 240, and cavity 233 between flat underside 231 and attachment means 240. The attachment means 240 is comprised of lower surface 241, sleeve 242, and internal eccentric collar 244 having a smaller diameter than sleeve 242, and being offset therefrom, thus forming edge 243. The oboe peg adapter 230 attaches to peg stand base 12 in a manner identical to that described above for the piccolo peg adapter 200. The oboe peg adapter 230 is of a size and shape which will accomodate the flare end of an oboe (not shown)by lowering the flare end over the oboe peg adapter 230 until the instrument is securely seated on instrument support surface 236.

Figure 11:
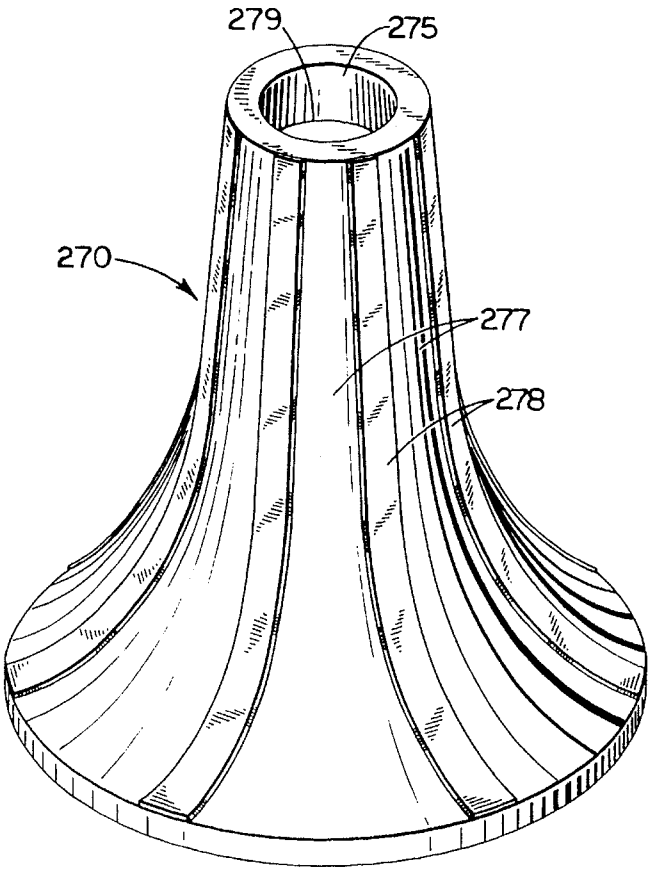
FIG. 11 is a isometric view of a trumpet peg adapter.

FIG. 11 depicts a trumpet adapter 270, having a smooth outer surface 277, a plurality of vertically oriented raised bands 278, and a top opening 275. A narrow ridge 279, substantially equal in width and depth to groove 252 of clarinet peg adapter 250, and located a distance from the top end of the trumpet adapter substantially the same as the distance from the top edge of the clarinet peg adapter 250 to groove 252, forms a circle inside top opening 275. FIG. 12A illustrates the underside of trumpet adapter 270, said underside being comprised of outer lower surface 271, inner lower surface 273, inner cavity 276, and a plurality of raised rib pairs 280 and 281, equal in number to the number of recessed outer surfaces 237 and 257 found on oboe peg adapter 230 and clarinet peg adapter 250, respectively.

Figure 12B:
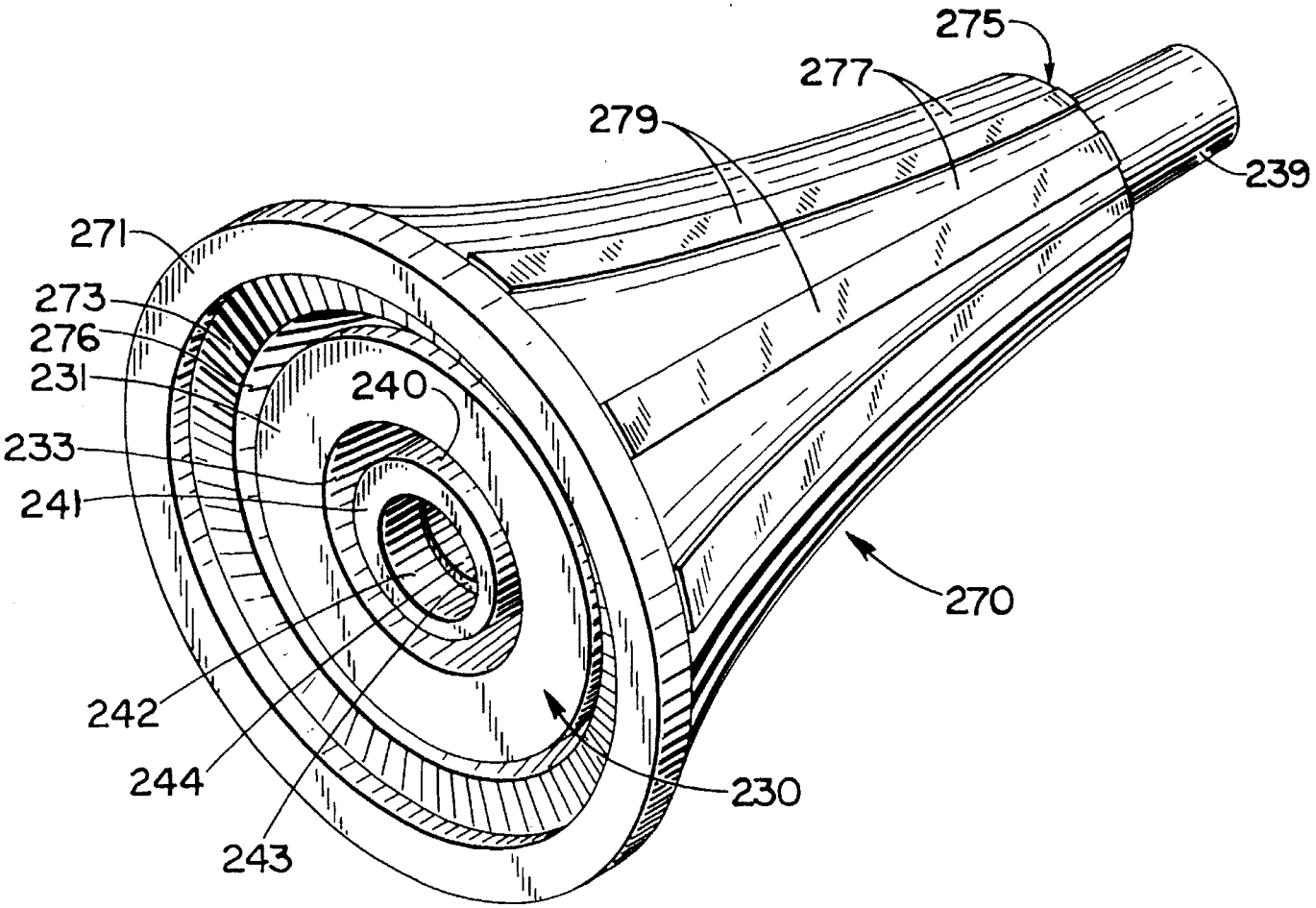
FIG. 12B is a isometric view showing the trumpet peg adapter in place on the oboe peg adapter.

Trumpet adapter 270 is used in two ways. The first alternative preferred embodiment of trumpet adapter 270 is in conjunction with oboe peg adapter 230, as depicted in FIGS. 12A and 12B. The oboe peg adapter 230 is inserted into inner cavity 276 of trumpet adapter 270, being oriented so that raised rib pairs 280 and 281 are substantially in alignment with recessed outer surfaces 237 of oboe peg adapter 230. When trumpet adapter 270 and oboe peg adapter 230 are properly nested, lip 236 of oboe peg adapter 230 bypasses inner lower surface 273 of trumpet adapter 270 and rests just inside cavity 276, and tubular extension 259 protrudes through top opening 275 of trumpet adapter 270. The resulting configuration is then attached to peg stand base 12 in a manner identical to that described above for piccolo peg adapter 200.

The preferred embodiment of the trumpet adapter 270 is in conjunction with clarinet peg adapter 250 (embodiment not shown). The clarinet peg adapter 250 is inserted into inner cavity 276 of trumpet adapter 270, being oriented so that raised rib pairs 280 and 281 are substantially in alignment with recessed outer surfaces 257 of clarinet peg adapter 250. Clarinet peg adapter 250 is secured in trumpet adapter 270 by applying pressure, which causes ridge 279 to snap into groove 252. When trumpet adapter 270 and clarinet peg adapter 250 are properly nested, instrument support surface 256 of clarinet peg adapter 250 abuts inner lower surface 273 of trumpet adapter 270. The resulting configuration (not shown) is then attached to peg stand base 12 in a manner identical to that described above for piccolo peg adapter 200.

In the foregoing discussion, reference is made to the attachment of piccolo peg adapter 200 and other instrument adapters to peg stand base 12 by means of peg 30 and collar 32. Removable bi-peg adapter 14 supports two pegs 80 and 82, and two collars 84 and 86 which are identical in form and function to peg 30 and collar 32. Therefore, all instrument adapters described herein are interchangeably attachable to any of the peg configurations described herein.

It should be noted that the foregoing describes preferred embodiments of the disclosed invention. Other embodiments, while not shown in the drawings, are also contemplated, including an alternative preferred embodiment of attachment means 88, in which attachment means 88 is fixedly attached to plate 16. An alternative preferred embodiment of the peg stand base 10 is contemplated, wherein plate 16 is fixedly attached to base 12. An additional preferred embodiment of peg stand base 10 contemplates a plurality of pegs permanently affixed. In alternative preferred embodiment of removable bi-peg adapter 14, the use of a plurality of pegs is contemplated. Additional preferred embodiments also contemplate the use of other attachment means, including threaded peg adapters and pegs, and snap-on peg adapters.

A successful prototype of the present invention was made from injection molded plastic. However, the use of other materials, such as metal, wood, and rubber, is also contemplated.

In compliance with the applicable statutes, the invention has been described in language more or less specific as to structural features. While this invention is susceptible to embodiment in different forms, the drawings and the specification illustrate preferred embodiments of the invention, with the understanding that the present disclosure is to be considered an exemplification of the principles of the invention, and the disclosure is not intended to limit the invention to the particular embodiments described.

I claim:

1. A wind musical instrument stand for temporarily, accessibly storing a wind musical instrument, said instrument stand interconnectable to a conventional music stand, comprising:

a base for stabilizing said stand upon a floor surface;

a wind instrument support member anchorable to said base for stably supporting a wind musical instrument; and interconnecting attachment means connectable to said instrument stand and to said music stand for securely interconnecting said instrument stand to said music stand.

2. The wind instrument stand of claim 1, wherein said interconnecting attachment means includes an elongate, music stand attachment strut removably interconnectable between said instrument stand base and an upright support member of said music stand.

3. The wind instrument stand of claim 2, wherein said base includes a horizontal deck plate and an upright, stand-coupling plate connected to said deck plate, said stand-coupling plate having adjustable, lockable strut-retaining means for adjustably, lockably receiving an instrument stand coupling end of said attachment strut.

4. The wind instrument stand of claim 3, wherein said strut has a music stand coupling end separated from said instrument stand coupling end by an upwardly curved strut portion and a horizontally bent strut portion, said music stand coupling end having a terminal mounting clamp, said mounting clamp having a vertically oriented mounting aperture adapted to securely embrace said upright support member.

5. The wind instrument stand of claim 3, wherein said coupling plate is hingedly connected to said deck plate.

6. The wind instrument stand of claim 3, wherein said strut-retaining means includes a strut retainer attached to said coupling plate, said retainer defining an angularly upward extending strut receptacle for receiving said instrument stand coupling end of said strut, wherein said instrument stand coupling end includes a straight terminal arm correspondingly angled with said strut receptacle to seat therein, and wherein said retaining means further includes a strut engaging, locking member for adjustably, lockably securing said terminal arm within said receptacle.

7. The wind instrument stand of claim 6, wherein said receptacle is in the form of an open groove, wherein said terminal arm forms a flattened strip adapted to seat within said groove, and wherein said strut engaging, locking member comprises an eccentrically pivotable locking cam attached to said coupling plate opposite said groove for securely, adjustably locking said terminal arm within said groove.

8. A wind musical instrument stand for temporarily, accessibly storing a wind musical instrument, comprising:

abase for stably supporting said stand upon a floor surface;

an anchoring peg extending from an upper surface of said base for removably anchoring an instrument peg adapter to said base; and an instrument peg adapter removably anchorable to said anchoring peg for stably supporting a wind musical instrument, said instrument peg adapter having a peg-mounting base defining a hollow mounting receptacle shaped and dimensioned to receive said anchoring peg, and wherein said anchoring peg is non-threaded and is shaped and dimensioned to frictionally engage said instrument peg adapter to facilitate rapid, manual mounting and detachment of said instrument peg adapter to and from said instrument stand base.

9. A wind musical instrument stand according to claim 8, wherein said mounting receptacle has an upper, internal eccentric collar portion forming an eccentric seating edge, and a lower, sleeve portion, said internal collar portion having a smaller internal diameter than said sleeve portion, said internal collar and sleeve portions being shaped and dimensioned to engage, respectively, upper, collar mating and lower, sleeve mating portions of said anchoring peg, and wherein said anchoring peg sleeve mating portion forms an eccentric mounting edge alignable with said seating edge, whereby said instrument peg adapter may be rapidly, friction mounted on said anchoring peg by engaging said sleeve and internal collar portions of said reservoir around said sleeve engaging and collar engaging portions of said anchoring peg, respectively, to align said seating edge with said mounting edge, and thereafter angularly rotating said instrument peg adapter relative to said anchoring peg to angularly offset said seating edge relative to said mounting edge and thereby frictionally lock internal walls of said sleeve and internal collar portions of said reservoir against opposing sides of said sleeve engaging and collar engaging portions of said anchoring peg.

10. A wind musical instrument stand according to claim 8, wherein said instrument peg adapter has an integral, instrument support surface extending laterally from a base of said peg adapter for upwardly supporting a flare end of said wind instrument.

11. A wind musical instrument stand according to claim 8, including a widening instrument adapter removably attachable to said instrument peg adapter to convertibly provide said peg adapter with a wider base configuration than provided by said peg adapter alone to upwardly support a wind instrument having a wide flare end.

12. A wind instrument stand according to claim 11, wherein said widening instrument adapter has an interior wall defining an inner cavity shaped and dimensioned for nestably engaging an outer surface of said instrument peg adapter.

13. A wind instrument stand for temporarily, accessibly storing a wind musical instrument, comprising:

a base for stably supporting said stand upon a floor surface:

an anchoring peg extending from an upper surface of said base for removably anchoring an instrument peg adapter to said base;

an instrument peg adapter removably anchorable to said anchoring peg for stably supporting a wind musical instrument:

a widening instrument adapter removably attachable to said instrument peg adapter to convertibly provide said instrument peg adapter with a wider base configuration than provided by said instrument peg adapter alone, to upwardly support a wind instrument having a wide flare end, wherein said widening instrument adapter has an interior wall defining an inner cavity shaped and dimensioned for nestably engaging an outer surface of said instrument peg adapter; and nesting, angular fixation means interposed between said interior wall and said outer surface to nestingly, angularly fix said widening instrument adapter relative to said instrument peg adapter.

14. A wind instrument stand according to claim 13, wherein said fixation means includes corresponding longitudinal ridges and grooves interlockably arrayed on said interior wall and said outer surface.

15. A modular wind musical instrument stand for securely supporting a plurality of wind musical instruments, comprising:

a base for stably supporting said stand upon a floor surface;

a wind instrument support anchorable to said base for stably supporting a wind musical instrument in an upright position relative to said base, said instrument support having a unitary, horizontal instrument support surface; and a modular, base expanding adapter plate removably connectable to said base, said adapter plate having a supplemental instrument support anchorable to said adapter plate, said supplemental support having a unitary, horizontal instrument support surface.

16. A modular wind instrument stand according to claim 15, wherein said adapter plate has slidable coupling means to slidably couple to said base to allow rapid, manual attachment and detachment of said plate to and from said base.

17. A modular wind instrument stand according to claim 15, wherein said adapter plate has an anchoring peg extending from an upper surface of said plate for removably anchoring said supplemental instrument support to said plate.

18. A modular instrument stand according to claim 17, wherein said supplemental instrument support includes an instrument peg adapter having a mounting peg base defining a hollow mounting receptacle shaped and dimensioned to receive said anchoring peg, and wherein said anchoring peg is non-threaded and is shaped and dimensioned to frictionally engage said instrument peg adapter to facilitate rapid, manual mounting and detachment of said instrument peg adapter to and from said adapter plate.

19. A modular wind instrument stand according to claim 15, including interconnecting attachment means interconnectable between said stand and an upright support member of a conventional music stand, for securely interconnecting said instrument stand to said music stand.

* * * * *